US009959720B2

(12) United States Patent
Jaronczyk

(10) Patent No.: US 9,959,720 B2
(45) Date of Patent: May 1, 2018

(54) INPUT ZONE ENHANCER AND METHOD

(71) Applicant: Cezary Jan Jaronczyk, Toronto (CA)

(72) Inventor: Cezary Jan Jaronczyk, Toronto (CA)

( * ) Notice: Subject to any disclaimer, the term of this patent is extended or adjusted under 35 U.S.C. 154(b) by 0 days. days.

(21) Appl. No.: 15/088,728

(22) Filed: Apr. 1, 2016

(65) Prior Publication Data

US 2017/0213432 A1 Jul. 27, 2017

Related U.S. Application Data

(60) Provisional application No. 62/281,495, filed on Jan. 21, 2016.

(51) Int. Cl.

| | |
|---|---|
| ***G08B 13/00*** | (2006.01) |
| ***G08B 13/12*** | (2006.01) |
| ***G08B 13/02*** | (2006.01) |

(52) U.S. Cl.

CPC ..... *G08B 13/12* (2013.01); *G08B 13/02* (2013.01)

(58) Field of Classification Search

CPC .... G08B 13/13; G08B 26/002; G08B 25/018; G08B 13/00; G08B 13/08; G08B 13/02; G08B 13/04; G08B 13/12

USPC ..... 340/541, 540, 545.1, 545.2, 545.6

See application file for complete search history.

(56) References Cited

U.S. PATENT DOCUMENTS

| | | | | |
|---|---|---|---|---|
| 3,786,501 | A | 1/1974 | Marnerakis | |
| 4,622,541 | A | 11/1986 | Stockdale | |
| 4,651,138 | A * | 3/1987 | Morrison | G08B 25/018 340/506 |
| 4,751,498 | A * | 6/1988 | Shalvi | G08B 26/002 340/3.51 |
| 5,128,650 | A * | 7/1992 | Peters | B60R 25/1003 180/287 |
| 6,084,509 | A | 7/2000 | Simpson | |
| 6,696,940 | B2 | 2/2004 | Marino et al. | |
| 7,187,259 | B1 * | 3/2007 | Habboosh | H01H 9/0207 335/205 |
| 7,323,978 | B2 | 1/2008 | Parker et al. | |
| 2007/0210915 | A1 * | 9/2007 | Addy | G08B 25/08 340/531 |
| 2011/0127919 | A1 * | 6/2011 | Lin | H05B 33/083 315/185 R |
| 2013/0176132 | A1 * | 7/2013 | Bush | H04L 63/1416 340/657 |

* cited by examiner

*Primary Examiner* — Anh V La

(57) ABSTRACT

A burglar alarm system with an input zone enhancer using a power source with random variable timing or voltage to supply the zone loop. The input zone enhancer measures the current flowing through a zone loop of a burglar control unit. A method includes providing random variable timing and a voltage to supply the zone loop. A method includes directly measuring the current flowing through a hard wired zone loop of a burglary control unit in order to overcome sensitivities associated with electromagnetic noise. A method includes detecting compromise attempts by calculating a correlation of two signals, the zone loop current and the reference current, and by calculating the autocorrelation of the zone loop current with itself at different points in time.

14 Claims, 6 Drawing Sheets

INPUT ZONE ENHANCER AND METHOD

CROSS-REFERENCE TO RELATED APPLICATIONS

This application claims the benefit of U.S. Provisional Patent Application Ser. No. 62/281,495, filed Jan. 21, 2016, the entirety of which is incorporated herein by reference.

FIELD OF THE INVENTION

The present invention relates to burglar alarm systems, and in particular, relating to a zone input enhancer and method for preventing defeat of mechanical barriers of a burglar alarm system, and a burglar alarm system having a zone input enhancer.

BACKGROUND OF THE INVENTION

In the field of burglary alarm systems, mechanical contacts and switches controlling the status of doors, windows, and other similar mechanical barriers are often used. Known devices are hardwired to the zone inputs of burglary control units. The status of contacts and switches (whether closed, open, disconnected or shorted) are controlled (verified) by measuring constant voltage on hardwired connection loops. Because the current or voltage are constant for a particular status of the contact or switch, known burglary alarm devices can be easily compromised by substituting the electrical voltage and/or current presented in the hardwired zone loop by an outside source. Additionally, the sub-circuit controlling the status of the contact or switch usually works by measuring the voltage level of the zone loop, and thus is sensitive to the negative impact of the surrounding low-level electromagnetic energy noise. There is a need for a burglary alarm system that overcomes these drawbacks, namely a burglary alarm system that cannot be easily compromised and is less sensitive to low-level electromagnetic energy noise, as well as a method of use related thereto.

SUMMARY OF THE INVENTION

A zone enhancer (sometimes referred to as an input zone enhancer) can be inserted between a mechanical contact or switch and a typical hardwired zone input of a burglary control unit, or be a built-in feature in a burglary control unit, in order to enhance the security level of burglary alarm systems against compromise attempts.

It can have positive or negative randomly variable voltage and randomly variable timing or voltage of the predefined variable profile that supplies the zone loop with a contact or switch hardwired into the zone input.

The input zone enhancer can also directly measure the current flowing through the input zone of the enhancer, thereby increasing the input's immunity towards surrounding electromagnetic noises.

The input zone enhancer calculates the correlation of two signals, the zone loop current and the reference current or voltage, to detect the changes in the current over a determined time frame as an indication of a compromise attempt.

The input zone enhancer calculates the autocorrelation of two signals with the loop zone current and with itself at different points in time to detect changes in the current over determined time frame as an indication of the compromise attempt.

In modern designs of a burglary alarm systems having hardwire zone loops, the detection of the zone loop's status changes is based on comparison of a voltage level presented in zone loop input terminals with the predefined reference voltage level.

In the normal status of the zone loop in the case when, for example, a door is closed or opened, the zone loop resistance is determined by a single resistor or two resistors serially connected. Usually these resistors have the same resistance, so the voltage level of the zone loop input terminal has a determined level of voltage (one resistor) or of 100% higher (two resistors).

The burglary control unit compares the voltage level of zone input terminal to a determined referenced constant voltage level. If the voltages have almost the same levels that would mean that the door is closed (one resistor in a zone loop). If one of the compared voltages differs by about 100% or 50%, it means that the door was opened (two serial resistors in a zone loop).

But when the zone loop is cut, then there is no current flowing through the zone loop wires, resulting in an increase the voltage level up to the maximum level, that is to about 200%, usually equal to power source of the zone loop. If the zone loop wires are shorted, then the voltage level on the input terminal drops to almost 0. Thus the voltage level of the input terminals determines clearly the status of the protected zone, that is whether, for example, a door closed, opened, or the zone loop is cut or shorted.

The same status detection roles are applied in a zone loop enhancer devices, with the difference that the referenced voltage level changes continuously, following the voltage level pastern of the zone loop power which is randomly variable and of randomly variable timing.

Because a zone loop enhancer's MCU is continuously reading in real time the current or voltage level of the zone loop, and it also at the same time reads the reference voltage level, then based on the mathematical or DSP (Digital System Process) functions named correlation and autocorrelation, one can continuously calculate if there is a difference in compared signals and estimate the quantity of the change (level and phase).

In correlation, two signals are used, the signal of the zone loop input terminal and the signal of the referenced voltage (of randomly variable levels with randomly variable timing). If there are rapid changes in the zone loop current's level as compared with the referenced signal changes, it would indicate a compromise attempt.

In autocorrelation, one signal is a signal of the zone loop input terminal and the second signal is the same signal just slightly delayed in time. As the MCU generates a randomly variable voltage of randomly variable timing, it also predicts in what time frames the changes of the generated signal are be the predicted smooth or linear changes. If in those time frames a phase changes of zone loop current are detected, it would indicate a compromise attempt.

A zone loop enhancer device with an innovative way of detecting dynamic changes of zone loop current levels or phase using correlation and autocorrelation, allows for the status change signal (Alarm) to be generated based not only on traditional solutions, but will recognize sophisticated methods of compromise, which use the modern technology.

BRIEF DESCRIPTION OF DRAWINGS

The accompanying drawings, which are included to provide further understanding of the invention and are incorporated in and constitute a part of this specification, illustrate preferred embodiments of the invention and together with the description serve to explain the principles of the invention, in which.

DETAILED DESCRIPTION OF THE INVENTION

Figure 1:
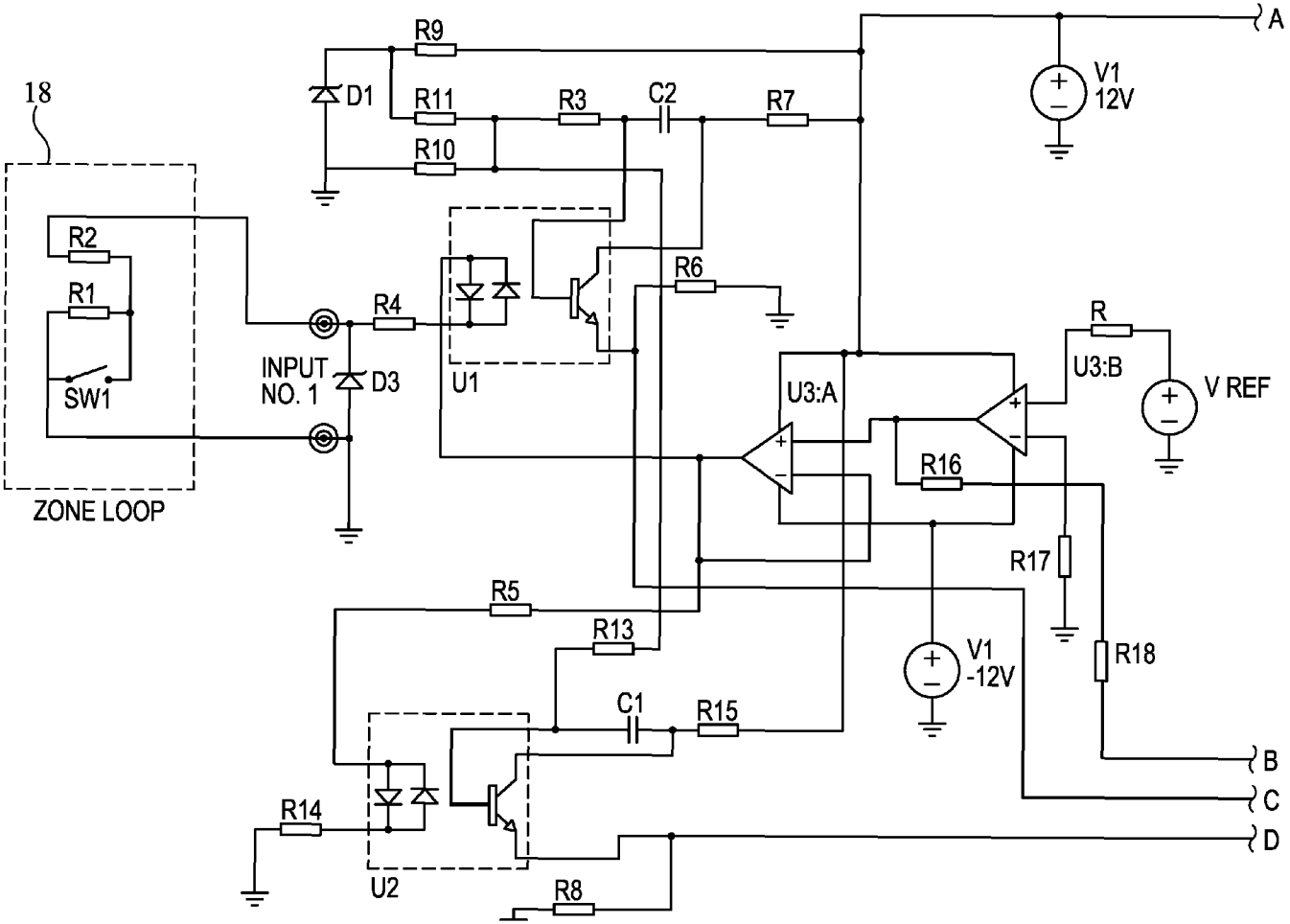
FIGS. 1-3 are a circuit diagram of an input zone enhancer in accordance with an embodiment of the present invention.
Figure 2:
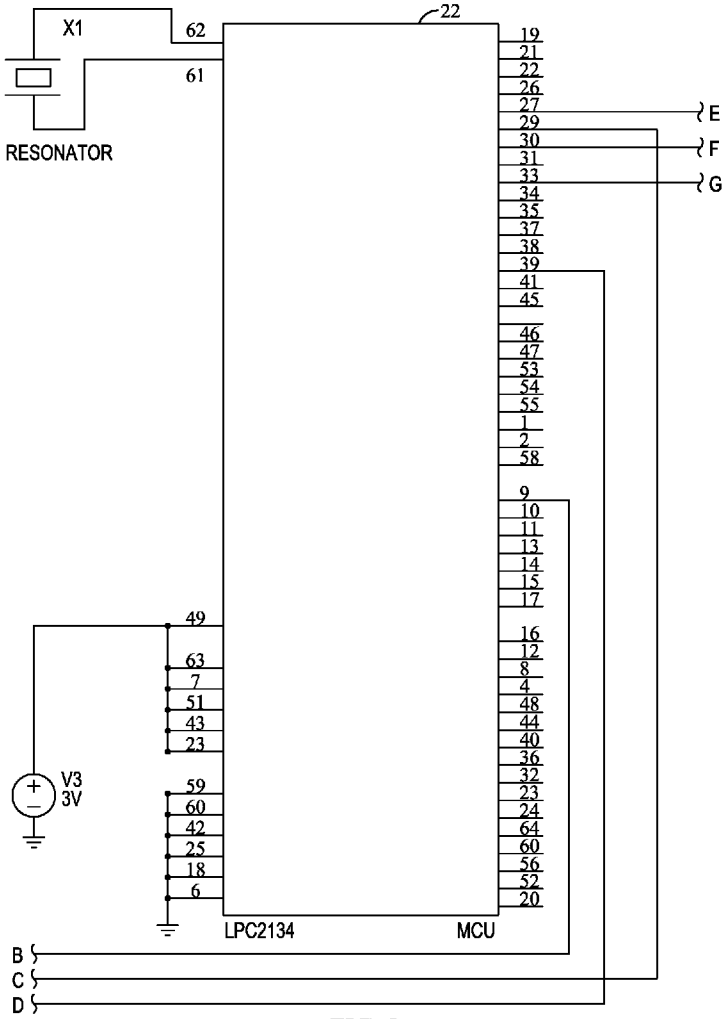
Figure 3:
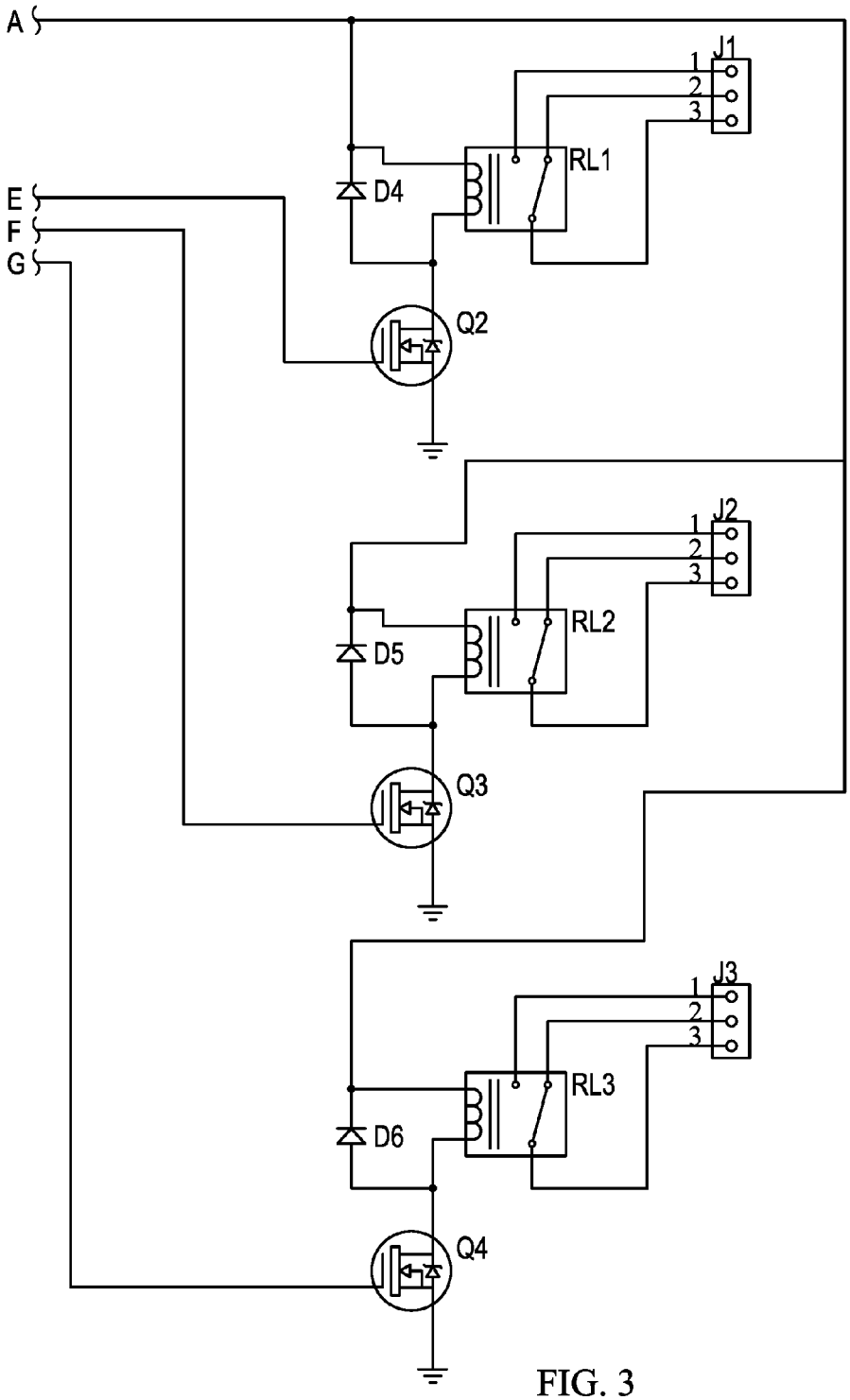
Figure 4:
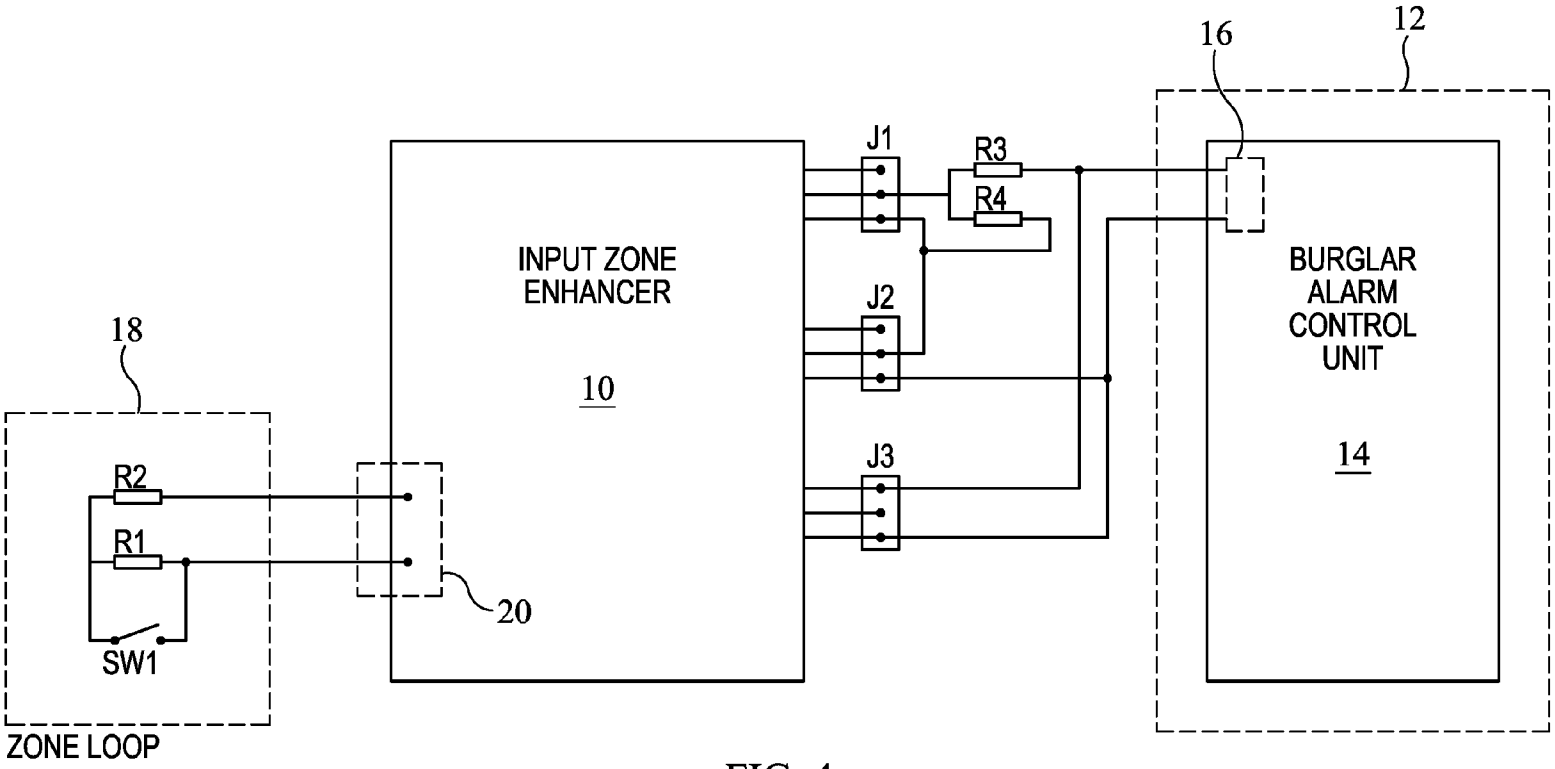
FIG. 4 is a schematic view of a burglar alarm system and an input zone enhancer in accordance with an embodiment of the present invention.

With reference to FIGS. 1 through 3, there is representatively illustrated circuitry of an input zone enhancer 10 for use in association with contacts and switches of a burglar alarm system to provide a very high level of security. In FIG. 4, there is shown a burglar alarm system 12 having a burglar alarm control unit 14 having hardwired zone inputs 16. There is also a contact means SW1 for indicating the status of a mechanical barrier of the burglar alarm system 12. The contact means SW1 can be mechanical or electronic, and indicates the circuit status, such as the presence of an open or closed circuit. The purpose of the contact means SW1 is to indicate the status of the mechanical barrier. There is also a zone loop 18 (or also referred to as a zone input) which has at least two terminals hardwired to the contact means SW1. There is also an input zone enhancer 10 having a zone input 20 with a minimum of two terminals having a power source providing random variable voltage to the zone input and providing output to the burglar control unit 14. The means of connection between the burglar control unit 14 and the input zone enhancer 10 can be a contact, an internet output, or an RS output of known old means.

Turning back to FIGS. 1-3, input of the input zone enhancer 10 connects to the external zone loop 18 with a contact or switch SW1, which is connected to resistors R1 and R2. These sub-circuits include a protection diode D3. R1 and R2 determine the values of current of the opening or closing status of the protected door or window or any other type of physical barrier.

The input zone enhancer 10 includes a micro-controller (MCU) 22, such as, for example, an NXP micro-controller LPC2134. The zone enhancer sub-circuit of the random variable voltage is generated by the MCU 22 and presented on D/A output (pin 9). This signal is amplified to the required level (around +/−3V to +/−12V) by the operational amplifier U3A and the output current is enhanced by the operational amplifier U3B with resistors R16, R17, R18 powers the hardwired zone loop 18, through the resistor R4, and the bidirectional opto-diodes of the opto-isolator U1. V1—12V are main circuits power sources and a V2—12V (of the negative polarity) additionally powers the amplifiers U3A and U3B, and the VREF—voltage source that modulates U3B's output signal positively or negatively, marked as VREF in FIG. 1.

The zone loop measuring the sub-circuit includes a photo transistor of opto-isolator U1, resistors R6, and the A/D input (29) of MCU 22. Resistors R3, R9, R10, R11, and Zener Diode D1 set the operation point for optimum signal transfer of U1 opto-isolator's photo transistor. Capacitor C2 filters high frequencies of external electromagnetic noises.

The reference voltage input sub-circuit that of random variable voltage includes opto-isolator's bidirectional diodes and photo transistor U2, resistors, R14, R5, and amplifier U3A supplying these reference sub-circuit with random variable current. The U2's photo transistor with resistors R8, R15 convert current to voltage, which is measured by the A/D input (39) of the MCU 22. R13 sets the operation point of photo transistor of U2. Capacitor C1 filters high frequencies of external electromagnetic noises.

The sub-circuit with the MCU 22, consists of resonator X1, V3 −3V powers the MCU. Transistors Q2, Q3, Q4 are controlled by the D/A outputs 27, 30 and 33 of the MCU 22. The protection diodes D4, D5, D6 and relays RL1, RL2, RL3 power the output terminals J1, J2, J3 which connects to the typical input zone of a burglar control unit 14 as shown in FIG. 4.

The firmware of the MCU 22 measures the values of input of the zone loop 18 and compares them with the reference voltage. When the state of the input zone changes (a switch or contact opens, the wire shorts or is cut, which would result in a different loop impedance), it will produce a difference in the voltage level of the loop zone compared to the reference voltage level and will generate the alarm.

Additionally, the MCU 22 calculates the correlation of two signals, the zone loop current and the random variable reference current, and also the autocorrelation of the zone loop current with itself at different points in time, and the results show the changes in current at the particular level which is an indication of a compromise attempt.

This will result in activating relay RL1, RL2 or RL3 depending on whether a switch or contact is opened (RL1), a wire is shorted (RL3) or cut (RL2) and accordingly changes the status of the burglar control unit 14. The firmware is also programmed to generate a random variable voltage (as shown in FIG. 6), either with or without with random variable timing of a predefined variable profile as shown in FIG. 6.

Figure 5:
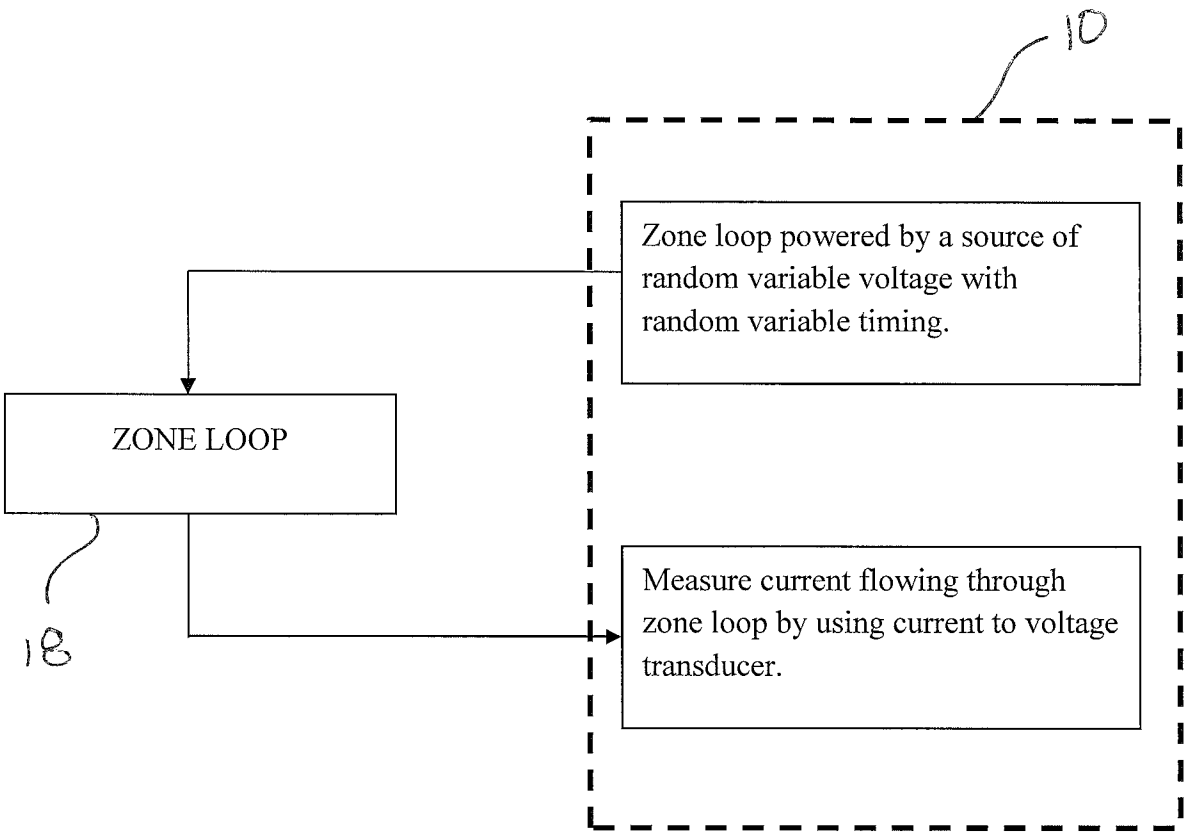
FIG. 5 is a block diagram showing both a zone loop powered by a source of random variable voltage with random variable timing, as well as a measuring means for measuring the current flowing through the zone loop by using a current to voltage transducer.

FIG. 5 is a block diagram which provides a power source with a random variable voltage level with a random variable timing or voltage of a predefined variable profile to power a burglar control unit hardwired zone loop. The block diagram also provides a method to measure the current flowing through the hard wired zone loop of a burglar control unit by applying a current to a voltage transducer.

Figure 6:
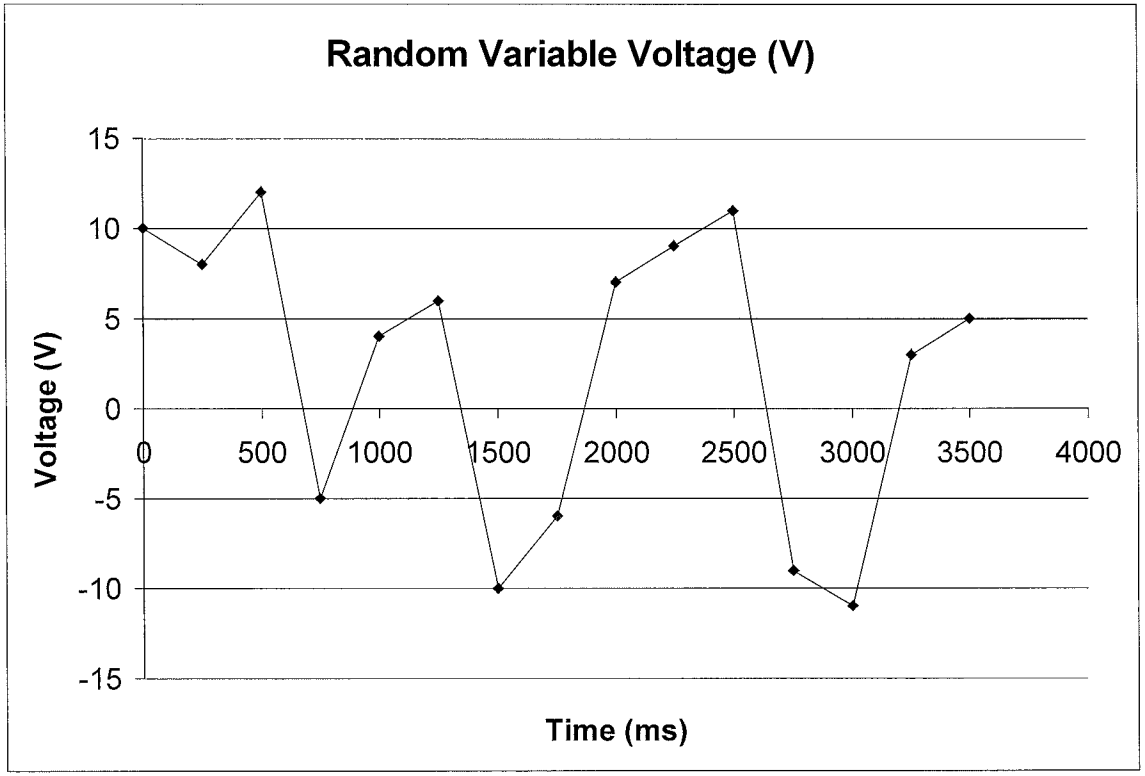
FIG. 6 is a graph showing a waveform with random variable voltage levels against constant time.

FIG. 6 is a graph showing a waveform with random variable voltage levels, with both positive and negative voltage against constant time. It is appreciated that both constant and variable time can be applied in association with the random variable voltage.

The burglar alarm system of the present invention may be fabricated from any suitable material commonly used in the industry.

In the burglar alarm systems design, a contact or switch securing doors, windows or other movable physical barrier (presented in the drawings by the SW1 and resistors R1, R2) is hardwired to the input zone of the burglary control unit or zone expander thus defining a zone loop.

This zone loop is powered by a constant voltage level and when a switch or contacts opens, or the wire is cut or shorted, the current in the loop will change. By measuring its value it can be determined which event happened, and generate an alarm or trouble status in the burglary alarm system. However as the voltage in the supplying loop is constant, it is easy to substitute the constant voltage and current externally, in order to disable the protecting zone.

However, if the voltage powering loop used a random variable voltage level with random variable timing, it would make it extremely difficult to substitute compromising voltage and current in order to disable to protecting zone.

The input zone enhancer 10 uses a power source with a random variable voltage level with random variable timing, instead of constant level voltage, to supply the zone loop 18.

Moreover, typical burglar alarm systems measure the status of the zone loop with a switch or contact by checking the voltage level in the input zone. However, this method of measuring voltage is characterized by input resistance in a Kilo Ohm range, and thus is sensitive to the negative impact of the surrounding electromagnetic noise.

The input zone enhancer 10, instead of measuring voltage level, will directly measure the current flowing through the zone loop, and transfer it into a corresponding voltage in order to increase immunity to the negative impact of the electromagnetic noise energy.

Numerous modifications, variations, and adaptations may be made to the particular embodiments of the invention described above without departing from the scope of the invention, which is defined in the claims.

What is claimed is:

1. A burglar alarm system for preventing the defeat of mechanical barriers, the burglar alarm system comprising:

a burglar alarm control unit having a zone input;

a zone loop;

an input zone enhancer connected to said zone loop and to said burglar alarm control unit, said input zone enhancer operating to provide a reference voltage having a random voltage value and to provide a zone loop voltage across said zone loop that has a voltage that corresponds to the voltage of said reference voltage;

said input zone enhancer further operating to measure a voltage across said zone loop and calculate a difference between the voltage measured across said zone loop and said reference voltage; and said input zone enhancer further operating to output a status signal to said zone input of said burglar alarm control unit that is indicative of a state of said zone loop based upon the difference between said voltage measured across said zone loop and said reference voltage.

2. The burglar alarm system of claim 1, wherein said input zone enhancer is integral to said burglar alarm control unit.

3. The burglar alarm system of claim 2, wherein said input zone enhancer further operates to randomize said reference voltage based upon a random.

4. The burglar alarm system of claim 3, wherein said reference voltage is positively variable.

5. The burglar alarm system of claim 3, wherein said reference voltage is negatively variable.

6. The burglar alarm system of claim 3, wherein said reference voltage is positively and negatively variable.

7. The burglar alarm system of claim 1, wherein said input zone enhancer further operates to randomize said reference voltage based upon a random timing.

8. The burglar alarm system of claim 7, wherein said reference voltage is positively variable.

9. The burglar alarms team eta claim 7, wherein said reference voltage is negatively variable.

10. The burglar alarm system of claim 7, wherein said reference voltage is positively and negatively variable.

11. The burglar alarm system of claim 1, herein said zone loop enhancer comprises:

a current measuring means for measuring a current status change in said zone loop.

12. The burglar alarm system of claim 1, wherein said zone loop enhancer further operates to detect a compromise attempt by calculating a correlation of a zone loop current and a reference current or voltage and detect a compromise attempt by calculating an autocorrelation of said zone loop current at different points in time.

13. The burglar alarm system of claim 2, wherein said zone loop enhance comprises:

a current measuring means for measuring a current status change in said zone loop.

14. The burglar alarm system of claim 2, wherein said zone loop enhancer further operates to detect a compromise attempt by calculating a correlation of a zone loop current and a reference current or voltage and detect a compromise attempt by calculating an autocorrelation of said zone loop current at different points in time.

* * * * *